US012473796B1

(12) United States Patent
Clark et al.

(10) Patent No.: US 12,473,796 B1
(45) Date of Patent: Nov. 18, 2025

(54) RELEASE ASSIST ASSEMBLY, AND METHOD, FOR DOUBLE GRIP PACKER WITH OPPOSED SLIPS

(71) Applicant: Target Completions LLC, Broken Arrow, OK (US)

(72) Inventors: Joseph Clark, Lago Vista, TX (US); Michael Thomas Sommers, Broken Arrow, OK (US)

(73) Assignee: TARGET COMPLETIONS LLC, Broken Arrow, OK (US)

( * ) Notice: Subject to any disclaimer, the term of this patent is extended or adjusted under 35 U.S.C. 154(b) by 0 days.

(21) Appl. No.: 19/222,343

(22) Filed: May 29, 2025

(51) Int. Cl.
*E21B 33/129* (2006.01)

(52) U.S. Cl.
CPC ..... *E21B 33/129* (2013.01)

(58) Field of Classification Search
CPC .. E21B 33/129; E21B 33/128; E21B 33/1291; E21B 33/1293; E21B 33/1295; E21B 33/12
See application file for complete search history.

(56) References Cited

U.S. PATENT DOCUMENTS

| | | | | |
|---|---|---|---|---|
| 3,460,616 | A * | 8/1969 | Crow | E21B 33/1295 166/212 |
| 3,570,596 | A * | 3/1971 | Young | E21B 33/1294 166/134 |
| 3,677,346 | A * | 7/1972 | Tamplen | E21B 23/006 166/217 |
| 4,530,398 | A * | 7/1985 | Greenlee | E21B 23/06 166/134 |
| 4,548,264 | A * | 10/1985 | Manderscheid | E21B 33/1292 166/216 |
| 4,903,777 | A * | 2/1990 | Jordan, Jr. | E21B 33/1291 166/134 |
| 5,046,557 | A | 9/1991 | Manderscheid | |
| 5,273,109 | A | 12/1993 | Arizmendi et al. | |
| 2002/0070034 | A1 * | 6/2002 | Whitsitt | E21B 33/12 166/134 |

FOREIGN PATENT DOCUMENTS

| | | |
|---|---|---|
| CA | 2782819 | 7/2014 |

* cited by examiner

*Primary Examiner* — Daniel P Stephenson
(74) *Attorney, Agent, or Firm* — Dennis D. Brown; Brown Patent Law, P.L.L.C.

(57) ABSTRACT

A release assist assembly and method for downhole tools, and a double grip packer having the release assist assembly installed therein wherein the release assist assembly operates under high downhole pressure conditions to relax and decompress the packing element of the packer to allow the slips of the packer to be released for mechanically retrieving the packer from the well.

13 Claims, 2 Drawing Sheets

RELEASE ASSIST ASSEMBLY, AND METHOD, FOR DOUBLE GRIP PACKER WITH OPPOSED SLIPS

FIELD OF THE INVENTION

The present invention relates to double grip downhole packers which have opposing pairs of slips, and to assemblies and methods for relaxing, releasing, and retrieving double grip packers and other downhole tools.

BACKGROUND OF THE INVENTION

A double grip downhole packer will typically comprise (i) at least one packing element assembly having at least one packing element and (ii) and an opposing pair of slip assemblies. The opposing pair of slip assemblies typically comprise an upper slip assembly and a lower slip assembly which are carried on a mandrel or mandrel string. The packing element assembly is also carried on the mandrel or mandrel string and is typically positioned between the upper and lower slip assemblies.

When setting the packer in the well, the opposing upper and lower slips are activated to bite the inner wall of the well casing and the packing element is compressed to pack the element off against the I.D. of the casing. The compression of the packing element into engagement with the casing seals the surrounding gap between the exterior of the packer and the casing I.D. After the packing element is set, the slips remain in engagement with the casing in order to (i) hold the packing element in compression and (ii) prevent the packer from moving in the casing.

When a double grip packer is used in a high pressure well wherein the pressure below the packer is in the range of from about 8,000 psi to as much as 15,000 psi or higher, an extreme amount of stored energy, oftentimes up to 150,000 lbs or more, can be trapped in the compressed packing element. Heretofore, the amount of stored energy trapped in the compressed packing element under such high pressure conditions has made it extremely difficult, and often impossible, to relax and decompress the packing element sufficiently to release the upper slips and thereby allow the packer to be mechanically released and lifted out of the well.

Prior attempts to alleviate this problem have, at best, been only marginally successful even when operating at lower pressures in the intermediate pressure range.

Consequently, a need exists for a release assembly and method, for use in a double grip packer apparatus under high downhole pressure conditions, which will operate to relax and decompress the packing element of the packer to allow the slips of the packer to be released for mechanically retrieving the packer from the well.

SUMMARY OF THE INVENTION

The present invention provides a release assist assembly and method for an opposed slip packer which satisfies the needs and alleviates the problems mentioned above. The release assist assembly operates under high downhole pressure conditions to relax and decompress the packing element of the packer to allow the slips of the packer to be released for mechanically retrieving the packer from the well.

In addition to being useable in generally any type of double grip packer having opposed slips, the inventive release assist assembly can also be adapted for use in bridge plugs, line hangers, hydraulic set packers, and other downhole tools.

In one aspect, there is provided a release assist assembly for releasing slips in a downhole apparatus. The release assist assembly preferably comprises: (i) a mandrel or mandrel string; (ii) an outer dog housing through which the mandrel or mandrel string extends; (iii) a slip cone structure or assembly through which the mandrel or mandrel string extends, the slip cone structure or assembly having an upper end portion which extends into the outer dog housing; (iv) one or more dog elements which extend through the upper end portion of the slip cone structure or assembly into one or more inner cavities formed within the outer dog housing; (v) a dog release sleeve cap through which the mandrel or mandrel string extends, the dog release sleeve cap having a lower end portion which extends into the outer dog housing; (vi) a dog release sleeve through which the mandrel or mandrel string extends, the dog release sleeve having a lower end portion which is positioned between the exterior of the mandrel or mandrel string and the one or more dog elements and an upper end portion which extends into the dog release sleeve cap; and (vii) an inner release assist snap ring or collet through which the mandrel or mandrel string extends, the inner release assist snap ring or collet being positioned within the dog release sleeve cap.

In another aspect, there is provided a double grip packing apparatus. The double grip packing apparatus preferably comprises: (a) a mandrel or mandrel string; (b) an upper slip assembly through which the mandrel or mandrel string extends; (c) a packing element assembly, below the upper slip assembly, through which the mandrel or mandrel string extends; (d) a packing element retaining sleeve through which the mandrel or mandrel string extends, the packing element retaining sleeve having an upper end in engagement with the packing element assembly; (e) a release assist assembly, below the packing element assembly, through which the mandrel or mandrel string extends; and (f) a lower slip assembly, below the release assist assembly, through which the mandrel or mandrel string extends, the lower slip assembly including a slip cone structure or assembly.

The release assist assembly of the double grip packing apparatus preferably comprises: (i) an outer dog housing which is secured on and extends downwardly from a lower end of the packing element retaining sleeve, (ii) an upper end portion of the slip cone structure or assembly of the lower slip assembly which extends into the outer dog housing, (iii) one or more dog elements which extend through the upper end portion of the slip cone structure into one or more inner cavities formed within the outer dog housing; (iv) a dog release sleeve cap having a lower end portion which extends into the outer dog housing; (v) a dog release sleeve having a lower end portion which is positioned between the exterior of the mandrel or mandrel string and the one or more dog elements and an upper end portion which extends into the dog release sleeve cap; and (vi) an inner release assist snap ring or collet positioned within the dog release sleeve cap.

The release assist assembly will preferably also comprises: (1) an exterior mandrel upset, or an exterior mandrel snap ring, carried on the mandrel or mandrel string; (2) the exterior mandrel upset, or the exterior mandrel snap ring, will snap through the inner release assist snap ring or collet when delivered downwardly into engagement with the inner release assist snap ring or collet; and (3) the exterior mandrel upset, or the exterior mandrel snap ring, will catch and pull the inner release assist snap ring or collet upwardly when delivered upwardly into engagement with the inner release assist snap ring or collet.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
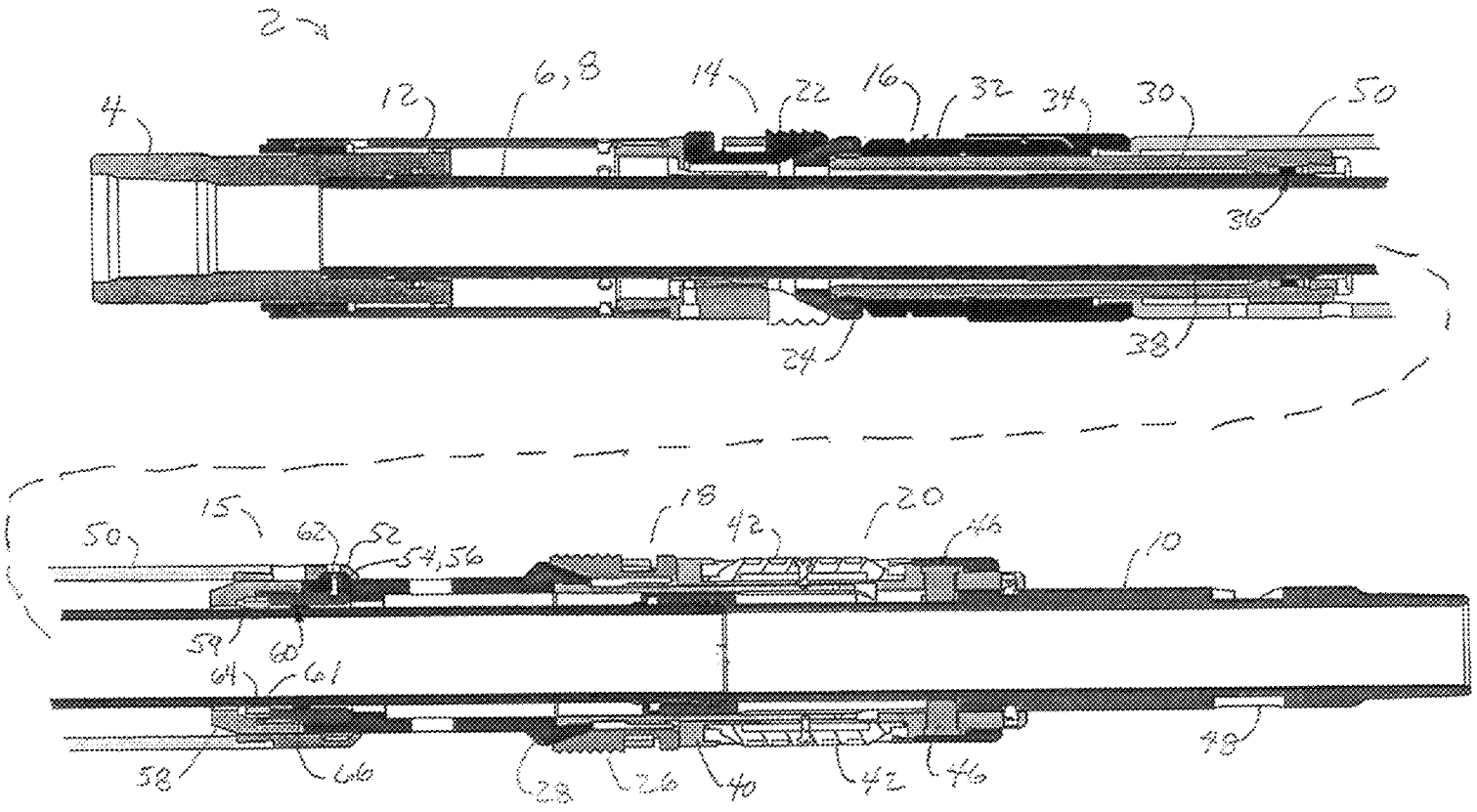
FIG. 1 is a cross-sectional view of an embodiment 2 of the double grip downhole packing apparatus provided by the present invention wherein the double grip packing apparatus 2 includes an embodiment 15 of the inventive release assist assembly and the packing apparatus 2 is shown in a set configuration.
Figure 2:
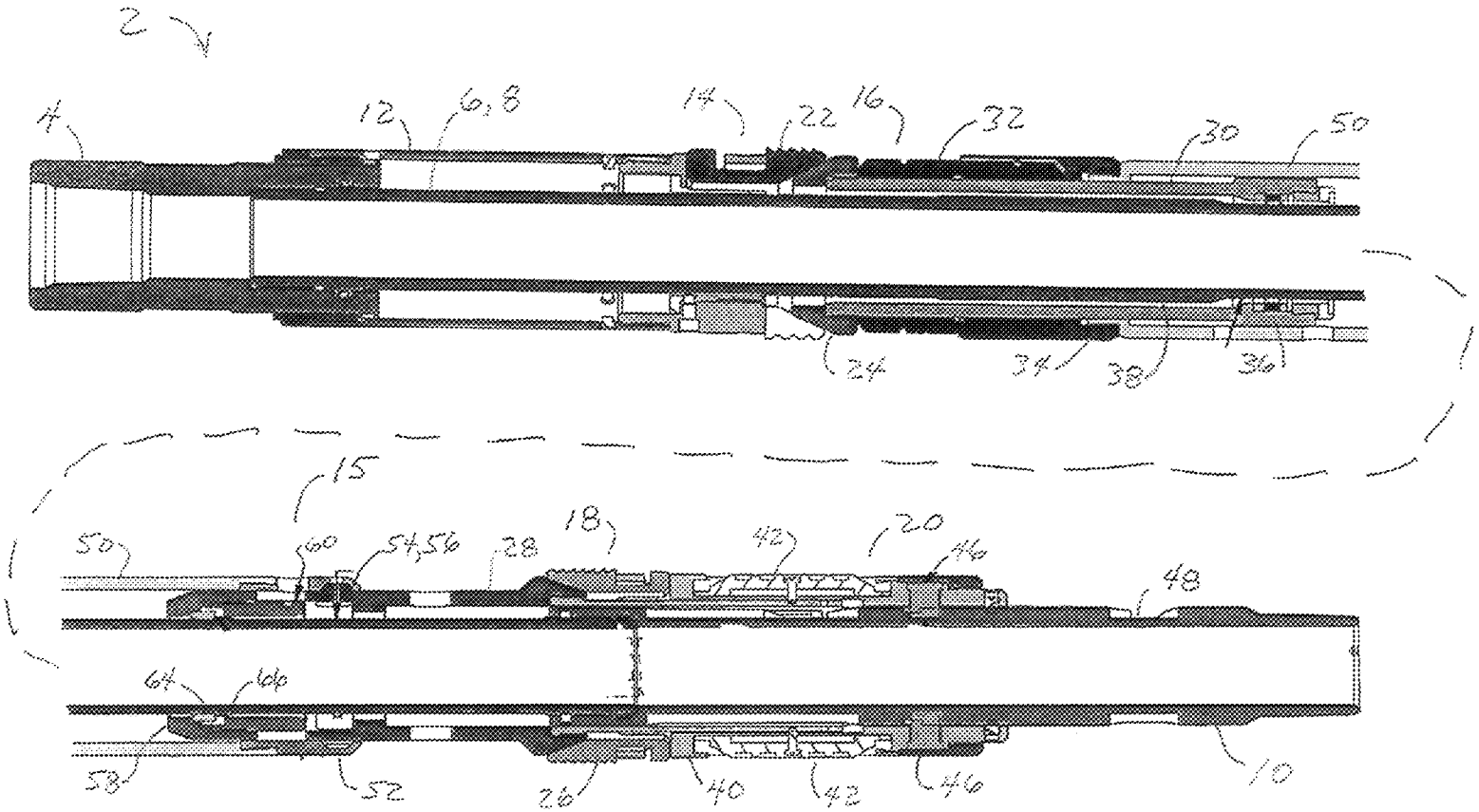
FIG. 2 is another cross-sectional view of the inventive double grip downhole packing apparatus 2 wherein the packing apparatus 2 is shown in a release configuration.

An example embodiment 2 of an inventive, double grip, downhole packing apparatus having an embodiment 15 of the inventive release assist assembly installed therein is illustrated in FIGS. 1 and 2. The inventive double grip packer 2 comprises a top sub 4 and a mandrel string 6 which extends downwardly from the top sub 4. The mandrel string 6 comprises an inner mandrel 8 and a J-slot mandrel 10 which extends downwardly from the lower end of the inner mandrel 8. The mandrel string 6 extends downwardly through: (i) a spring cage 12; (ii) an upper slip assembly 14; (iii) a packing element assembly 16; (iv) the inventive release assist assembly 15; (iv) a lower slip assembly 18; and (v) a drag block assembly 20.

The inventive double grip packer 2 can be secured on the end of a tubing string for running the packer 2 into a well and mechanically setting the packer 2 by compression and/or tension setting. Alternatively, the inventive packer 2 can be pinned in a wireline run-in configuration using wireline screws and shear pins for wireline-setting the packer 2 in the well using, e.g., a Baker #20 setting tool or other wireline device.

As used herein and in the claims, terms such as up and down, top and bottom, above and below, upward and downward, upwardly and downwardly, and upper and lower merely refer to the orientation of the inventive double grip packer 2 and the inventive release assist assembly 15 when positioned in a vertical portion of the well. Consequently, if, for example, the inventive double grip packer 2 is located in a horizontal portion of the well, the lower or bottom end of the double grip packer 2 would simply be the end of the packer 2 which is furthest downhole.

The term "about", when used herein and in the claims in reference to a length or distance or pressure, means±5%.

The upper slip assembly 14 of the inventive double grip packer 2 comprises a plurality of upper slips 22 and an upwardly facing upper cone 24 which is received under the upper slips 22 to urge the upper slips 22 into engagement with the I.D. of the well casing. Similarly, the lower slip assembly 18 comprises a plurality of lower slips 26 and a downwardly facing lower cone structure or cone assembly 28 having a cone which is received under the lower slips 26 to urge the lower slips 26 into engagement with the I.D. of the casing.

The packing element assembly 16 comprises: a packer support sleeve 30 through which the inner mandrel 8 extends; a packing element 32 which is positioned around the packer support sleeve 30; and a lower gage ring 34 which is positioned around the packer support sleeve 30 beneath, and against the bottom end of, the packing element 32. The upper end of the packer support sleeve 30 is received in and holds the upper cone 24. The lower end of the packer support sleeve 30 includes a bypass seal 36. When setting the packer 2, the bypass seal 36 is received around and seals against an upper portion of the inner mandrel 8 having an enlarged outer diameter 38 to thereby prevent circulation through the packing element 32.

Examples of materials suitable for forming the packing element 32 include, but are not limited to, Hydrogenated Nitrile Butadiene Rubber (HNBR) such as Ecner HNBR, or Ecner Aflas™.

The drag block assembly 20 comprises: a drag block body 40; a plurality of drag blocks 42 which are retained in the body 40; a plurality of drag block springs positioned in the body 40 beneath the drag blocks 42 for continuously urging the drag blocks 42 outwardly into contact with the inner wall of the well casing; and a plurality of J-slot pins 46 which extend radially inward and are received in the mandrel J-slots 48 formed in the exterior of the J-slot mandrel 10.

The frictional contact between the drag blocks 42 and the I.D. of the well casing provides an amount of resistance which is sufficient to prevent the drag block assembly 20, and the J-slot pins 46 thereof, from rotating when the mandrel string 6 is selectively lifted, rotated, and/or lowered within the drag block body 40 merely for purposes of repositioning the J-slot pins 46 in the mandrel J-slots 48. This allows the J-slot pins 46 to be selectively repositioned (i) against run-in shoulders within the mandrel J-slots 48 to prevent the engagement of the slips 22 and 26 when running the double grip packer 2 into the well or (ii) in longitudinally extending linear portions of the mandrel J-slots for compression setting the packer 2 or (iii) against tension shoulders within the mandrel J-slots 48 for tension setting the packer 2 or (iv) against retrieval shoulders within the mandrel J-slots 48 for retrieving the packer 2 from the well.

The inventive release assist assembly 15 used in the double grip packer 2 comprises: (i) a packing element retaining sleeve 50 having an upper end which engages the lower end of the lower gage ring 34 of the packing element assembly 16; (ii) an outer dog housing 52 which is secured on and extends downwardly from the lower end of the packing element retaining sleeve 50; (iii) one or more dog elements 54 which extend outwardly through an upper portion of the lower cone structure 28 into one or more inner cavities 56 formed in the outer dog housing 52; (iv) a dog release sleeve cap 58 which is positioned within the outer dog housing 52 and can upwardly extend into the lower end of the packing element retaining sleeve 50; (v) a dog release sleeve 60 having an upper end which is held in the dog release sleeve cap 58 and a lower end which is positioned beneath the dog elements 54 to hold the one or more dog elements 54 in the inner cavities 56 of the outer dog housing 52 so that the dog elements 54 are prevented from collapsing inwardly; and (vi) one or more shear screws or pins 62 which extend through the one or more dog elements 54 into the dog release sleeve 60.

The dog element(s) 54 and the outer dog housing 52 hold the packing element retaining sleeve 50 and the lower cone structure or assembly 28 together for running the double grip packer 2 into the well, and for setting and using the packer 2.

The inventive release assist assembly 15 further comprises: (a) an inner release assist snap C-ring (or alternatively a fingered collet structure) 64 positioned within the dog release sleeve cap 58 between a downwardly facing inner shoulder 59 of the dog release sleeve cap 58 and an upwardly facing inner shoulder 61 of the dog release sleeve 60 and (b) an exterior mandrel upset 66 (preferably tapered) which is formed around the inner mandrel 8 (or alternatively a snap ring in a mandrel groove). The exterior mandrel upset or snap ring 66 will snap through the inner release assist snap ring or collet 64 if delivered downwardly into engagement with the inner release assist snap ring or collet 64 but will catch and pull the inner snap ring or collet 64 upwardly if delivered upwardly into engagement with the inner release snap ring or collet 64.

FIG. 1 illustrates the configuration of the double grip packer 2 when set in a well. In this configuration, the upper and lower slips 22 and 26 have been forced outwardly by the upper and lower cones 24 and 28 and the packing element 32 is compressed such that the packing element 32 is packed-off against the I.D. of the well casing. In this set configuration, the upper and lower slips 22 and 26 grip the inner surface of the casing to hold the packing element 32 in compression and prevent the packer 2 from moving upwardly or downwardly in the well. In the set configuration of the packer 2 as illustrated in FIG. 1, the mandrel upset or release ring 66 on the exterior of the mandrel 8 is positioned below the inner release assist snap ring or collet 64 of the release assist assembly 15.

When using the inventive release assist assembly 15 for releasing the double grip packer 2 and retrieving the packer 2 from the well, the J-slot pins 46 of the drag block assembly 20 will typically first be repositioned such that the J-slot pins 46 are located in linear retrieval segments of the mandrel J-slots 48. By way of example, but not by way of limitation, the mandrel J-slots can be configured such that, in order to reposition the J-slot pins 46 in the linear retrieval segments of the mandrel J-slots 48, the mandrel string 6 is set downward within the packer 2 and then rotated, e.g., a quarter of a turn to the right.

Next, the mandrel string 6 is picked up such that the exterior mandrel upset or release ring 66 catches the inner release assist snap ring or collet 64 inside the dog release sleeve cap 58 and pulls the inner release assist snap ring or collet 64 upward. As it is carried upward, the inner release assist snap ring or collet 64 engages the downwardly facing shoulder 59 within the dog release sleeve cap 58 to also pull the dog release sleeve cap 58 upward. As the dog release sleeve cap 58 is carried upward, the cap 58 simultaneously pulls the dog release sleeve 60 upward from beneath the one or more dog elements 54 as illustrated in FIG. 2, thereby also shearing the dog shear screws or pins 62 and allowing the one or more dogs 54 to collapse inwardly out of the inner dog receiving cavities 56 of the outer dog housing 52.

As a result, because the dog element(s) 54 are no longer positioned in the inner cavities of the outer dog housing 52 to hold the packing element retaining sleeve 50 and the lower cone structure 28 together, the packing element retaining sleeve 50 is now allowed to freely shift downwardly to release the compression force which (i) is stored in the compressed packing element 32 and (ii) is acting on the upper cone 24 to prevent the disengagement of the upper slips 22. Consequently, as the mandrel string 6 is then pulled further upward within the packer 2, the upper slips 22 are fully released, the lower cone 28 is pulled away from the lower slips 26, and the double grip packing apparatus can be pulled out of the well.

Thus, the present invention is well adapted to carry out the objectives and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. A release assist assembly for releasing slips in a downhole apparatus comprising:

a mandrel or mandrel string;

an outer dog housing through which the mandrel or mandrel string extends;

a slip cone structure or assembly through which the mandrel or mandrel string extends, the slip cone structure or assembly having an upper end portion which extends into the outer dog housing;

one or more dog elements which extend through the upper end portion of the slip cone structure or assembly into one or more inner cavities formed within the outer dog housing;

a dog release sleeve cap through which the mandrel or mandrel string extends, the dog release sleeve cap having a lower end portion which extends into the outer dog housing;

a dog release sleeve through which the mandrel or mandrel string extends, the dog release sleeve having (i) a lower end portion which is positioned between an exterior of the mandrel or mandrel string and the one or more dog elements and (ii) an upper end portion which extends into the dog release sleeve cap; and an inner release assist snap ring or collet through which the mandrel or mandrel string extends, the inner release assist snap ring or collet being positioned within the dog release sleeve cap.

2. The release assist assembly of claim 1 further comprising the inner release assist snap ring or collet being positioned within the dog release sleeve cap between the dog release sleeve and an inner shoulder of the dog release sleeve cap.

3. The release assist assembly of claim 1 further comprising:

an exterior mandrel upset, or an exterior mandrel snap ring, carried on the mandrel or mandrel string;

the exterior mandrel upset, or the exterior mandrel snap ring, will snap through the inner release assist snap ring or collet when delivered downwardly into engagement with the inner release assist snap ring or collet; and the exterior mandrel upset, or the exterior mandrel snap ring, will catch and pull the inner release assist snap ring or collet upwardly when delivered upwardly into engagement with the inner release assist snap ring or collet.

4. The release assist assembly of claim 3 further comprising:

the inner release assist snap ring or collet will pull the dog release sleeve cap upwardly as the inner release assist snap ring or collet is pulled upwardly by the exterior mandrel upset of the exterior mandrel snap ring;

the dog release sleeve cap will pull the dog release sleeve upwardly, to remove the lower end portion of the dog release sleeve from between the exterior of the mandrel or mandrel string and the one or more dog elements, as the dog release sleeve cap is pulled upwardly by the inner release assist snap ring or collet; and the one or more dog elements will collapse out of the one or more inner cavities of the outer dog housing when the lower end portion of the dog release sleeve is removed from between the exterior of the mandrel or mandrel string and the one or more dog elements.

5. The release assist assembly of claim 4 further comprising:

a shear screw or pin extending through each of the one or more dog elements into the lower end portion of the dog release sleeve and the shear screw or pin being sheared when the dog release sleeve is pulled upwardly by the dog release sleeve cap.

6. The release assist assembly of claim 4 further comprising the outer dog housing being secured on and extending downwardly from a lower end of a packing element retaining sleeve through which the mandrel or mandrel string extends.

7. The release assist assembly of claim 6 further comprising:

the packing element retaining sleeve operating to hold a compressive force on a packing element and the compressive force on the packing element will be released when the one or more dog elements collapse out of the one or more inner cavities of the outer dog housing.

8. A double grip packing apparatus comprising:

a mandrel or mandrel string;

an upper slip assembly through which the mandrel or mandrel string extends;

a packing element assembly, below the upper slip assembly, through which the mandrel or mandrel string extends;

a packing element retaining sleeve through which the mandrel or mandrel string extends, the packing element retaining sleeve having an upper end in engagement with the packing element assembly;

a release assist assembly, below the packing element assembly, through which the mandrel or mandrel string extends;

a lower slip assembly, below the release assist assembly, through which the mandrel or mandrel string extends, the lower slip assembly including a slip cone structure or assembly; and the release assist assembly comprising an outer dog housing which is secured on and extends downwardly from a lower end of the packing element retaining sleeve, an upper end portion of the slip cone structure or assembly of the lower slip assembly which extends into the outer dog housing, one or more dog elements which extend through the upper end portion of the slip cone structure assembly into one or more inner cavities formed within the outer dog housing;

a dog release sleeve cap having a lower end portion which extends into the outer dog housing;

a dog release sleeve having (i) a lower end portion which is positioned between an exterior of the mandrel or mandrel string and the one or more dog elements and (ii) an upper end portion which extends into the dog release sleeve cap; and an inner release assist snap ring or collet positioned within the dog release sleeve cap.

9. The double grip packing apparatus of claim 8 further comprising the inner release assist snap ring or collet being positioned within the dog release sleeve cap between the dog release sleeve and an inner shoulder of the dog release sleeve cap.

10. The double grip packing apparatus of claim 8 further comprising:

an exterior mandrel upset, or an exterior mandrel snap ring, carried on the mandrel or mandrel string;

the exterior mandrel upset, or the exterior mandrel snap ring, will snap through the inner release assist snap ring or collet when delivered downwardly into engagement with the inner release assist snap ring or collet; and the exterior mandrel upset, or the exterior mandrel snap ring, will catch and pull the inner release assist snap ring or collet upwardly when delivered upwardly into engagement with the inner release assist snap ring or collet.

11. The double grip packing apparatus of claim 10 further comprising:

the inner release assist snap ring or collet will pull the dog release sleeve cap upwardly as the inner release assist snap ring or collet is pulled upwardly by the exterior mandrel upset or the exterior mandrel snap ring;

the dog release sleeve cap will pull the dog release sleeve upwardly, to remove the lower end portion of the dog release sleeve from between the exterior of the mandrel or mandrel string and the one or more dog elements, as the dog release sleeve cap is pulled upwardly by the inner release assist snap ring or collet; and the one or more dog elements will collapse out of the one or more inner cavities of the outer dog housing when the lower end portion of the dog release sleeve is removed from between the exterior of the mandrel or mandrel string and the one or more dog elements.

12. The double grip packing apparatus of claim 11 further comprising:

a shear screw or pin extending through each of the one or more dog elements into the lower end portion of the dog release sleeve and the shear screw or pin being sheared when the dog release sleeve is pulled upwardly by the dog release sleeve cap.

13. The double grip packing apparatus of claim 8 further comprising:

the packing element assembly including one or more packing elements;

the packing element retaining sleeve operating to hold a compressive force on the one or more packing elements; and the compressive force on the one or more packing elements will be released when the one or more dog elements collapse out of the one or more inner cavities of the outer dog housing.

* * * * *